US005918910A

United States Patent [19]

Stillwagon et al.

[11] Patent Number: 5,918,910

[45] Date of Patent: Jul. 6, 1999

[54] PRODUCT TRACKING SYSTEM AND METHOD

[75] Inventors: Thomas J. Stillwagon, Englewood; John Long, West Chester, both of Ohio

[73] Assignee: NCR Corporation, Dayton, Ohio

[21] Appl. No.: 08/994,698

[22] Filed: Dec. 19, 1997

[51] Int. Cl.[6] ..... B42D 15/00

[52] U.S. Cl. ..... 283/67; 283/70; 283/74; 283/79; 283/80; 283/85; 283/115; 235/375; 235/383; 235/385

[58] Field of Search ..... 283/67, 70, 74, 283/79, 80, 85, 115; 235/375, 383, 385; 53/135.1, 415; 493/961, 375; 156/247, 249, DIG. 2

[56] References Cited

U.S. PATENT DOCUMENTS 4,340,810 7/1982 Glass ..... 235/385
5,271,642 12/1993 Jahier et al. .
5,524,758 6/1996 Lupul ..... 283/67
5,562,310 10/1996 Henry ..... 283/67
5,612,957 3/1997 Gregerson et al. .
5,628,530 5/1997 Thornton ..... 283/67
5,752,723 5/1998 Robertson ..... 283/67
5,821,510 10/1998 Cohen et al. ..... 235/385

*Primary Examiner*—Andrea L. Pitts
*Assistant Examiner*—Toan Le
*Attorney, Agent, or Firm*—Charlene Stukenborg

[57] ABSTRACT

A system and method using a label for tracking the distribution of products such as promotional receipt rolls which include customized, targeted information is provided.

12 Claims, 2 Drawing Sheets

PRODUCT TRACKING SYSTEM AND METHOD

BACKGROUND OF THE INVENTION

The present invention relates to a system and method for tracking products through distribution, particularly such products as promotional receipt rolls or other items including customized, targeted information for a self-service terminal, an automated teller machine (ATM) or a point-of-sale terminal.

Paper receipt rolls or other items may be printed with promotional advertising or other customized, targeted information. The promotional advertising or other customized, targeted information often include information with a defined lifespan (such as expiration dates) or regional advertisements. These advertisements must reach the intended machine at the correct geographical location and in a timely manner. Therefore, it is important that the correct receipt rolls or other items including customized, targeted information are delivered to and installed in the appropriate machine in a timely manner.

It is known to provide a marking label for a product which becomes part of an assembly to enable retrieval of defective assemblies, for example, when a certain lot of assemblies contains products which may be defective. The marking label identification code indicates which assemblies include the suspect products. However, this marking label does not involve or otherwise indicate the location where a finished product is to be used, so it is not helpful for the situations described above.

There is a need for a system and method for tracking the distribution of products such as promotional receipt rolls which include customized, targeted information.

SUMMARY OF THE INVENTION

In accordance with the teachings of the present invention, a system and method using labels for tracking the distribution of products such as promotional receipt rolls which include customized, targeted information is provided.

It is an object of the present invention to provide tracking of products such as receipt rolls from the manufacturing plant or other facility at which customized, targeted, time-dependent information is encoded on the product (such as promotional messages on receipt rolls) to the final destination where the product is to be utilized.

It is an important feature of the present invention to provide a system and method which assists cash replenishers (for ATMs or other self-service machines) with installing promotional receipt rolls into the correct machines, taking into consideration the defined lifespan and geographical constraints of the promotional receipt rolls.

It is another feature of the present invention that the system and method is easily incorporated into the current operations of multiple cash replenishers.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION

Figure 1:
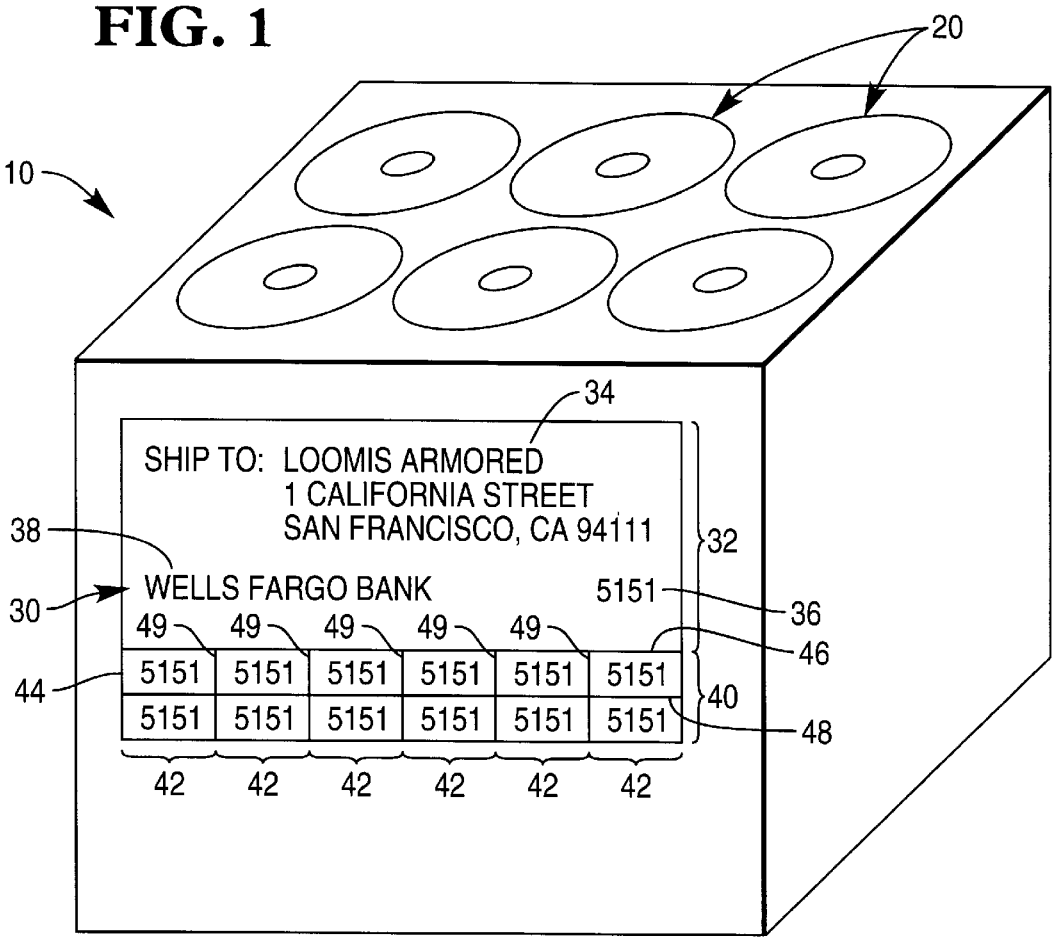
FIG. 1 is a diagram of a product and an exemplary label product of the present invention.

Referring now to the drawings, in which like-referenced characters indicate corresponding elements throughout the several views, attention is first drawn to FIG. 1.

FIG. 1 shows a shipping container 10 such as for shipping receipt rolls. The shipping container 10 includes a plurality of product 20 which is tracked using the exemplary sample label product 30 and the system and method of the present invention. The product 20 preferably includes promotional targeted information such as advertisements having a defined lifespan (such as an expiration date or other time period after which the advertisement is no longer relevant) or limited area of geographical relevance, preferably printed on the back side of the product such as a receipt roll. The label product 30 may include a shipping label 32 and a product label 40. The shipping label 32 may be attached to each shipping container 10. The shipping label 32 may include a shipping address 34 of the cash replenisher's regional office, an identification number that indicates a particular machine's location code 36 and identification information 38. In this example, 5151 indicates one particular ATM's location code 36. The identification information 38 may include the logo of the particular institution to assist the cash replenisher in keeping the institution's receipt rolls separated from other banks' media, for example Wells Fargo Bank.

The label product 30 includes a product label 40. The product label 40 preferably includes a plurality of multi-part labels to be placed on the product 20 as each is removed from the shipping container 10. The multi-part labels 42 include location code information 44 for the machine which the product is to be installed in, preferably information 44 corresponds to the location code 36 on the shipping label 32. The example label product 30 of FIG. 1 is configured for a carton of six ATM receipt rolls.

In this exemplary label product 30, there are six two-part labels 42 for each receipt roll for the ATM at location 5151. Each two-part label 42 is used to track the receipt roll from the carton to the armored vehicle and ultimately to the correct ATM. In addition to the location code information 44, the multi-part labels 42 may also include information such as expiration dates of the enclosed receipts or bar code information which may be scanned to determine that the correct roll is loaded.

The label product 30 of FIG. 1 may be formed using label stock or paper stock with a transfer tape or a pressure sensitive adhesive covered by release liner adhered to one side as described in U.S. Pat. No. 5,147,699 issued to Browning et al. and U.S. Pat. No. 4,876,131 issued to Ashby et al. which are hereby incorporated by reference. The label product 30 has a face stock, an adhesive layer and a release liner stock.

The multi-part labels 42 may include a diecut, knifecut, weak perforation or the like in the face stock at line 46 and no corresponding line in the release liner. The multi-part labels 42 may also include a perforation line or tear line in the face stock at line 48 and a corresponding diecut, knifecut or weak perforation line in the release liner. The multi-part labels 42 may also include a diecut, knifecut, weak perforation line or the like in the face stock at lines 49 and a perforation line or tear line in the release liner.

This series of lines will allow separation of a first part of the multi-part label with the adhesive exposed for placement on the product roll. The second part of the multi-part label will be attached to the first part of the multi-part label with its release liner still intact. The second part of the multi-part label will have its release liner removed at the ATM machine to enable placement in the log. The lines 49 are configured to enable each set of labels to be easily separated from each other. Obviously other configurations may be used as long as some means, for example an intact release liner or the like, is provided to keep the parts of the multi-part labels together as they are applied to the product.

Figure 2:
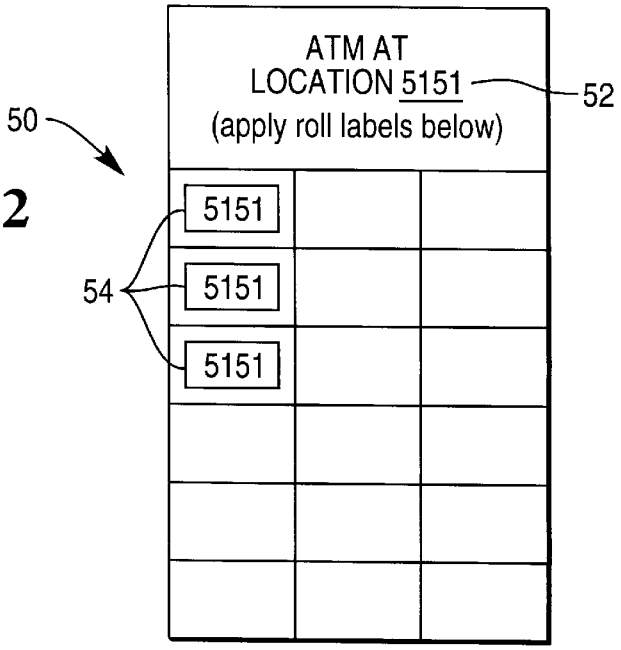
FIG. 2 is a block diagram of a log used in the system of the present invention.

FIG. 2 shows a block diagram of a log 50 for use in the system of the present invention. The log 50 includes an ATM location code 52 and space 54 for one part of each multi-part label 42 from each product installed in the ATM.

Figure 3:
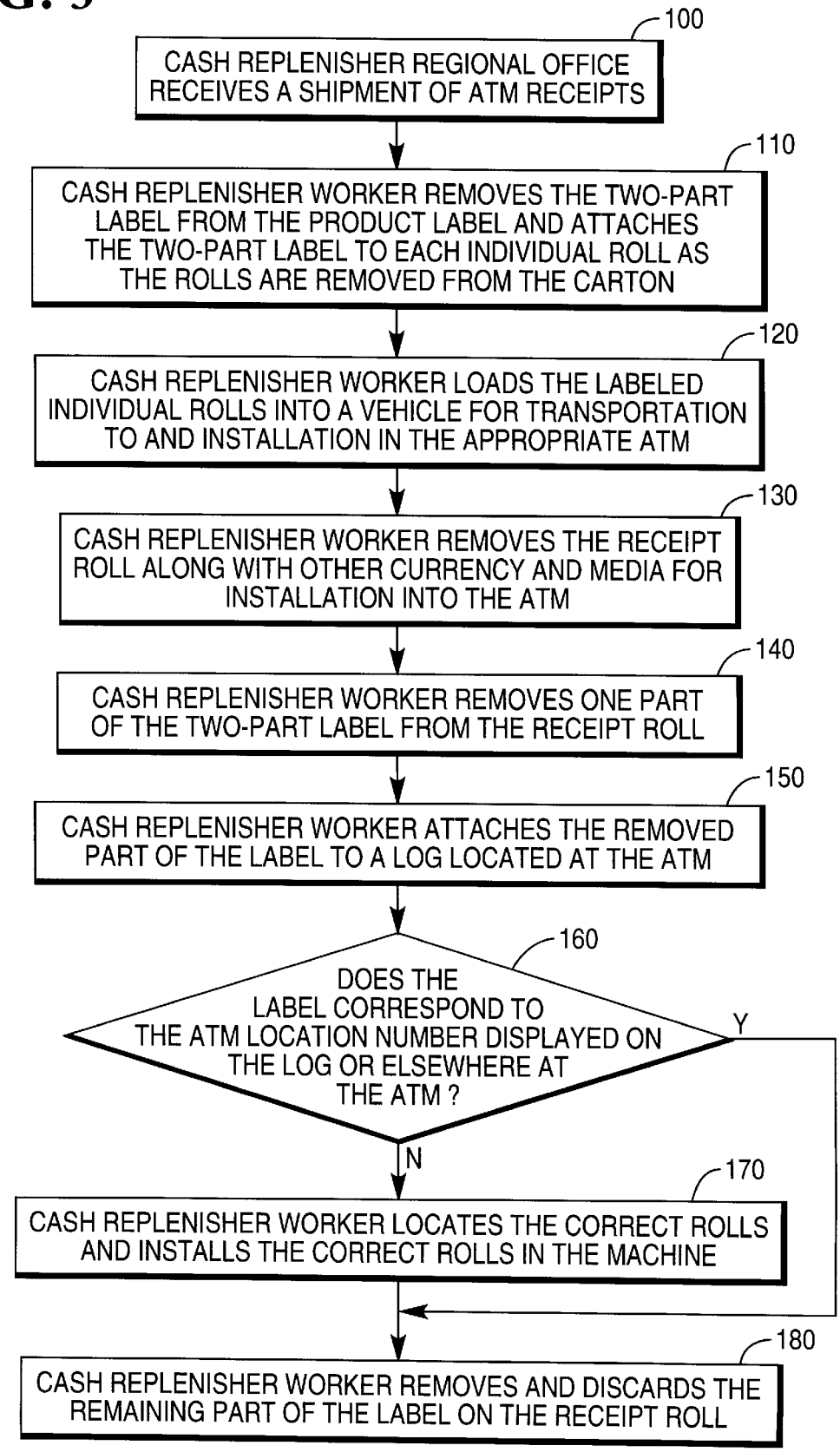
FIG. 3 is a flowchart of the method of using the system of the present invention.

Referring to FIG. 3, a flowchart of the method of the present invention used with promotional roll receipts for an ATM is provided. First, in step 100 the cash replenisher regional office receives a shipment of ATM receipt rolls from a manufacturer. The shipment includes multiple containers of ATM receipts. Each container may have a label product including a shipping label and a product label as described above.

Next in step 110, as part of the cash replenisher's daily operation, the cash replenisher worker removes the two-part label from the product label part and attaches the two-part label to each individual roll as the rolls are removed from the container. Preferably, the worker attaches the two-part label to the outermost receipt roll. Next in step 120, the workers load the labeled individual rolls into a vehicle for transportation to and installation in the appropriate ATM. Each two-part label indicates the ATM location identification number.

Next in step 130, at the appropriate ATM, the worker removes the receipt roll from the truck along with other media and currency for installation in the ATM. At this point, step 140, the worker removes one part of the two-part label from the receipt roll. Next, in step 150, the worker attaches the removed part of the label to a log (or other tracking binder) located at the ATM site. Next, in step 160, the worker checks if the information on the label corresponds to the ATM location number displayed prominently on the log or tracking binder. If the location identification numbers do not match, then, in step 170, the replenisher worker locates the correct receipt rolls and installs the correct rolls in the machine. Finally in step 180, the worker removes and discards the remaining part of the label on the receipt roll, in the normal or conventional process of discarding the first receipt because of adhesive used to keep the roll wound.

The logs (as shown in FIG. 2) in each machine provide a historical record of which receipts are placed into which machines, enabling auditing. Preferably, a database is created to track the products delivered, and the destination and the date delivered to the machine so the tracking system of the present invention may be automated using standard computer equipment such as a personal computer.

The term cash replenisher as used in the above described system and method is intended to include independent replenishers who service machines owned by others and workers of banks or other institutions who provide replenishing services for their own machines.

Although the method is described as using a two-part label, it is contemplated that a multi-part label may be used (having as many detachable parts as desired) if a log of all the receipts going into a vehicle is desired, or tracking at any other stop in the distribution process is desired.

Advantageously the system and method of the present invention requires minimal additional effort from the cash replenishers while insuring that the proper rolls are supplied to the correct machines in a timely fashion.

Although the exemplary label product 30 includes multi-part labels 42 having the same location code information 44, it is contemplated that if the same receipt roll can be used at a variety of locations, different location code information 44 may be provided on individual multi-part labels 42.

Additionally, although the exemplary label product 30 is shown including both a shipping label and the product labels, it is contemplated that the method of the present invention may be practiced without having a shipping label attached to the product labels if desired.

Although the invention has been described with particular reference to certain preferred embodiments thereof, variations and modifications of the present invention can be effected within the spirit and scope of the following claims.

What is claimed is:

1. A method of tracking the distribution of a product to determine if the product is installed at the appropriate machine, comprising the steps of:

providing a multi-part label having identifying information indicating the machine to be installed at on at least one part of the multi-part label;

attaching the multi-part label to the exterior of the product to be installed at the machine;

transporting the product to the machine;

removing at least one part of the multi-part label;

applying the removed part of the multi-part label to a log stored in proximity to the machine;

verifying that the information on the removed part of the multi-part label corresponds to identifying information on the machine;

removing the remaining part of the multi-part label; and installing a product at the machine.

2. The method of claim 1 wherein the product has a limited geographical area of use.

3. The method of claim 1 wherein the product has a defined lifespan.

4. The method of claim 1 further including auditing the machine log to insure the product was installed in the machine in accordance with the geographical and time constraints.

5. A multi-part label having location information corresponding to the location of a particular machine for use in the method of claim 1.

6. A method of tracking the distribution of receipt rolls printed with promotional information which is valid for a limited time or geographical location, comprising the steps of:

providing a multi-part label having identifying information indicating a machine that a particular receipt roll is to be installed at on at least one part of the multi-part label;

attaching the multi-part label to the receipt roll;

transporting the receipt roll to the machine;

removing one part of the multi-part label;

applying the removed part of the multi-part label to a log stored in proximity to the machine;

verifying that the information on the removed part of the multi-part label corresponds to identifying information on the machine;

removing a remaining part of the multi-part label; and installing the receipt roll at the machine.

7. The method of claim 6 wherein the receipt roll has a limited geographical area of use.

8. The method of claim 6 wherein the receipt roll has a defined lifespan.

9. The method of claim 6 further including auditing the machine log to insure the receipt roll was installed in the machine in accordance with geographical and time constraints.

10. A multi-part label having location information corresponding to the location of a particular machine for use in the method of claim 6.

11. A system for tracking the distribution of receipt rolls printed with promotional information which is valid for a limited time or geographical location, comprising:

a label product having a shipping label and a product label, wherein the shipping label attaches to a container of receipt rolls to provide a shipping address and wherein the product label includes at least one multi-part label which attaches to a receipt roll and includes location code information indicating a machine that the receipt roll is to be installed at; and a log stored in proximity to the machine for holding at least one part of each multi-part label of each receipt roll installed at the machine, wherein the machine includes location code information to be verified with the location code information on the multi-part label.

12. A system for tracking the distribution of receipt rolls printed with promotional information which is valid for a limited time or geographical location, comprising:

at least one multi-part product label which attaches to a receipt roll and includes location code information indicating a machine that the receipt roll is to be installed at; and a log stored in proximity to the machine for holding at least one part of each multi-part label of each receipt roll installed at the machine, wherein the machine includes location code information to be verified with the location code information on the multi-part label.

* * * * *